US010011412B2

(12) United States Patent
Taylor et al.

(10) Patent No.: US 10,011,412 B2
(45) Date of Patent: Jul. 3, 2018

(54) BULK BAG HOOK

(71) Applicant: PROCESS4, INC., Chagrin Falls, OH (US)

(72) Inventors: Curtis Taylor, Chagrin Falls, OH (US); Aaron Misener, Chagrin Falls, OH (US); Matthew Hanson, Chagrin Falls, OH (US)

(73) Assignee: Nestec S.A, Vevey (CH)

( * ) Notice: Subject to any disclaimer, the term of this patent is extended or adjusted under 35 U.S.C. 154(b) by 106 days.

(21) Appl. No.: 14/915,834

(22) PCT Filed: Aug. 21, 2014

(86) PCT No.: PCT/US2014/052061
§ 371 (c)(1),
(2) Date: Mar. 1, 2016

(87) PCT Pub. No.: WO2015/038306
PCT Pub. Date: Mar. 19, 2015

(65) Prior Publication Data

US 2016/0194131 A1 Jul. 7, 2016

Related U.S. Application Data

(60) Provisional application No. 61/875,768, filed on Sep. 10, 2013.

(51) Int. Cl.

| | |
|---|---|
| ***B65D 75/56*** | (2006.01) |
| ***B65D 33/00*** | (2006.01) |
| ***B65D 33/14*** | (2006.01) |
| *B31B 50/81* | (2017.01) |

(52) U.S. Cl.
CPC ..... *B65D 75/56* (2013.01); *B65D 33/004* (2013.01); *B65D 33/14* (2013.01); *B31B 50/81* (2017.08)

(58) Field of Classification Search
CPC ..... B65D 33/14; B62B 3/106; B62B 3/1464; B62B 3/1472; A45C 3/04
USPC ..... 383/22–25, 6, 14; 224/411; 280/33.992
See application file for complete search history.

(56) References Cited

U.S. PATENT DOCUMENTS

| | | | | |
|---|---|---|---|---|
| 4,832,301 | A * | 5/1989 | Hiramoto | G11B 23/0233 248/205.3 |
| 6,591,874 | B2 * | 7/2003 | Credle, Jr. | B65D 75/5877 141/10 |
| 2005/0018931 | A1 * | 1/2005 | Shrader | B65D 33/14 383/23 |
| 2005/0025393 | A1 * | 2/2005 | Heyniger | B65D 33/14 383/9 |
| 2006/0272976 | A1 * | 12/2006 | Pinney | A61J 1/00 206/466 |

* cited by examiner

*Primary Examiner* — Scott Mcnurlen
(74) *Attorney, Agent, or Firm* — Ronald A. Burchett; Julie M. Lappin

(57) ABSTRACT

A bulk bag hook for use on a bulk bag to releasably connect the bulk bag to a shopping cart. The bulk bag hook includes a base section that is secured to the bulk bag, a hook portion that is designed to releasably secure to a shopping cart, and a hinge that is connected between the base section and the hoof portion to enable the hook portion to move relative to the base section.

19 Claims, 4 Drawing Sheets

BULK BAG HOOK

CROSS REFERENCE TO RELATED APPLICATIONS

This application is a national stage application under 35 USC § 371 of PCT/US2014/052061 filed on Aug. 21, 2014 and claims priority to U.S. Provisional Application No. 61/875,768 filed Sep. 10, 2013, the disclosures of which are incorporated herein by this reference in their entireties.

The present invention relates to a hook system, particularly to a hook system for a bulk bag, and more particularly to a hook system for a bulk bag that can be easily connected to a standard shopping cart.

BACKGROUND OF THE INVENTION

Bulk bags are commonly used to package various types of commonly used items. Pet food, charcoal, cat litter, sand, gravel, cement, soil, mulch, flour, rice, sugar, maze, salt, beans, nuts, etc. are commonly packaged in large bulky bags. Due to the size and weight of these bulky bags, it can be difficult for some consumers to lift the bulky bag into a shopping cart or to bend down and place the bulky bag into the shopping cart. Furthermore, it can be difficult to remove the bulky bag from the shopping cart during the check-out process or when loading the bulky bag into a vehicle.

In view of the current state of the art, there is a need to increase the ease of a consumer when loading and unloading a bulky bag from a shopping cart.

SUMMARY OF THE INVENTION

The present invention is directed to a bulk bag hook that is secured to a bulk bag and which hook can be used to overcome the past handling limitations of prior art bulk bags. The bulk bag hook is designed to be secured to the top or bottom portion of a bulk bag and includes a hook portion that can be used to removably secure the bulk bag to one or more regions of a cart (e.g., cart handle, upper frame rim of the basket of the cart, etc.). In one non-limiting arrangement, the bulk bag hook is connected to the top or bottom portion of the bulk bag that includes the barcode or identification code of the bulk bag; however, this is not required. In addition, the bulk bag hook is generally connected to the side of the bulk bag that includes the barcode or identification code of the bulk bag; however, this is not required. Such a positioning of the bulk bag hook results in the easy scanning of the barcode or identification code during check-out while the bulk bag is hanging on the shopping cart via the bulk bag hook; however, this is not required. In one non-limiting configuration, the bulk bag hook is located on the end of the portion of the bag that includes the barcode or identification code or within a distance of the end that is less than 25% the longitudinal length of the bag, or within a distance of the end that is less than 20% the longitudinal length of the bag, or within a distance of the end that is less than 15% the longitudinal length of the bag, or within a distance of the end that is less than 10% the longitudinal length of the bag, or within a distance of the end that is less than 5% the longitudinal length of the bag. The barcode or identification code is an optical machine-readable representation of data relating to the object to which it is attached. The barcode can be in the form of vary widths and spacings of parallel lines, rectangles, dots, hexagons and other geometric patterns in two dimensions. Generally, the barcode or identification code can be read by a scanner. The barcode or identification code is commonly used by retailers to maintain product inventory and to scan a product during the purchase of a product. The bulk bag hook is generally centrally positioned between the two sides of the bulk bag or within ±15% of the central position between the two sides of the bulk bag, or within ±10% of the central position between the two sides of the bulk bag, or within ±5% of the central position between the two sides of the bulk bag. The bulk bag hook is generally designed and positioned on the bulk bag so that the bulk bag hook does not interfere with the stacking of a plurality of bulk bags having bulk bag hooks on top of one another; however, this is not required. The size, shape and material of the bulk bag hook are non-limiting. The type, size and shape of the bulk bag to which the bulk bag hook is connected are non-limiting. The bulk bag hook can be secured to the bulk bag prior to, during, or after the bulk bag is filled with its contents. Generally, the bulk bag hook is secured to the bulk bag prior to the bulk bag being closed or sealed with its contents; however, this is not required.

In one non-limiting aspect of the invention, the bulk bag hook includes a base section, a hook portion, and a hinge that connects the hook portion to the base section. The base section is designed to facilitate in securing the bulk bag hook to the bulk bag. The hook portion is designed to be removably secured to a shopping cart or the like so as to removably secure the bulk bag to the shopping cart. The hook portion can also be designed to function as a handle to enable a user to conveniently carry the bulk bag by the hook portion; however, this is not required. The hinge is designed to enable the hook portion to move relative to the base section.

In another and/or alternative non-limiting aspect of the invention, the base section can be connected to the bulk bag by a variety of means (e.g., adhesive, stitching, rivets, clamp, melt connection, friction connection, etc.). In one non-limiting arrangement, the base section includes one or more projections that extend outwardly from the back surface of the base section. The one or more projections are designed to penetrate partially or fully through the bulk bag and be secured to a clamp backing. The clamp backing including a connection arrangement for each end of the projections such that the ends of the projections snap connect to the clamp backing and thereby secure the base section to the front face of the bulk bag. As can be appreciated, the clamp backing can include one or more projections and/or both the clamp backing and the base section can include one or more projections which are used to secure the base section to the front face of the bulk bag. When the clamp backing includes one or more projections, the back face of the base section includes a connection arrangement to receive the end of the projections. The configuration of the connection arrangement is non-limiting. In one non-limiting configuration, the connection arrangement includes an opening that is designed to frictionally receive an end of a projection. The end of the projection is designed to be inserted partially or fully into the opening when a sufficient force is applied, and the end is designed to resist or be prevented from disengagement from the opening once the end portion of the projection is partially or fully positioned into the opening. As can be appreciated; many other or additional arrangements can be used to secure the base section to the clamp backing. The size, shape, configuration and materials used for the base section and the clamp backing are non-limiting. As can be appreciated, an adhesive, melt connection and/or stitching can be used in combination with or as an alternative to the use of the clamp backing. When an adhesive is used, the adhesive can be applied between the back face of the base section and the face of the bag and/or between the clamp backing and the bulk bag. The type of adhesive, when used, is non-limiting. When stitching is used, the stitching can be used to secure both the base section and the clamp backing to the bulk bag or just the base section or the clamp backing to the bulk bag. When a melt connection is used, the melt connection can be formed by heat, ultrasonic waves, etc. As can also be appreciated, stitching, melt connection and/or an adhesive can be used to secure the base section to the bulk bag without the use of the clamp backing; however, this is not required.

In still another and/or alternative non-limiting aspect of the invention, the hinge can be a living hinge, bearing hinge, floating hinge, etc. The hinge is designed to enable the hook portion to move relative to the base section. The hinge can be a single-piece component or multi-piece component. In one non-limiting arrangement, the hinge is a living hinge. In another and/or alternative non-limiting arrangement, the hinge is a one-piece component. In still another and/or alternative non-limiting arrangement, the hinge, the base section and the hook portion are a single component. In such an arrangement, the hinge, the base section and the hook portion can all be formed of the same material; however, this is not required. Also, in this arrangement, the thickness of all or a portion of the hinge is thinner than the base section and/or hook portion that is connected to and/or located closely adjacent to the hinge; however, this is not required. If the hinge is a separate piece from the base section and/or hook portion, the hinge can be connected to the base section and/or hook portion by various means (e.g., adhesive, melted bond, stitching, rivets, clamp, friction connection, etc.). The hinge can be located on the front end of the base section, the back end of the base section, the side of the base section, between the front and back end of the base section, or between the sides of the base section. When a portion of the base section is located on both sides of the hinge, generally the thickness of all or a portion of the hinge is thinner than the base section on each side of the hinge that is connected to and/or located closely adjacent to the hinge; however, this is not required.

In yet another and/or alternative non-limiting aspect of the invention, the hook portion includes a hooking section that has a shape selected from the group consisting of a generally C-shape, generally U-shape, or generally V-shape that is designed to removably connect to a portion of a shopping cart or the like. For example, the shape of the hooking section is designed to be removably connected to a portion of a shopping cart or the like and is generally designed so that the hook portion can be removably connected to the handle of the shopping cart, the front end of the shopping cart, back end of the shopping cart, sides of the shopping cart, etc.). The angle of curvature (e.g., radians) of the inner surface of the hooking section is generally about 90°-270°, typically 120°-250°, more typically about 150°-220°, and still more typically about 160°=200°. The hook portion can include a body section that is positioned between the hinge and the hooking section; however, this is not required. Generally, the body section is a straight piece along a majority of all of the longitudinal length of the body section; however, this is not required. The length of the body portion, when used, is such that when the body portion is generally positioned normal or tangentially to the top surface of the base section, the front end of the hooking section is spaced above the top surface of the base section; however, this is not required. Generally, the spaced distance is about 0.25-2 inches, typically 0.5-1.5 inches; however, other spacing distances can be used. The hooking section and the base section can be formed of a single piece or multiple pieces. The thickness and/or width of the hooking section and the base section can be the same or different.

In still yet another and/or alternative non-limiting aspect of the invention, there is provided a latch member for the hook portion to be releasably secured to the base section at a location that is spaced from the hinge. The latch member can be partially or fully located on the base section and/or the hook portion. The latch member is designed to hold the hook portion in a fixed position relative to the base section. The latch member can include many different arrangements (e.g., friction arrangement, snap arrangement, hook and loop connector, etc.). In one non-limiting arrangement, the latch member includes a connection tab on the top surface of the base section that is designed to engage the front portion of the hooking section of the hook portion when the hook portion is pivoted about the hinge toward the base section. The tab is designed to frictionally engage a region of the hooking section and to releasably hold the hooking portion in position relative to the base section. The tab is designed to allow the hook portion to disengage from the tab so that the hook portion can be pivoted on the hinge. As can be appreciated, other or additional arrangements can be used to enable the hooking portion to be releasably held in position relative to the base section.

One non-limiting object of the invention is the provision of a bulk bag hook that can be used to easily secure a bulk bag to a shopping cart.

Another and/or alternative non-limiting object of the invention is the provision of a bulk bag hook that includes a base section, a hinge and a hook portion.

Still another and/or alternative non-limiting object of the invention is the provision of a bulk bag hook that releasably connects a bulk bag to a shopping cart.

Yet another and/or alternative non-limiting object of the invention is the provision of a bulk bag hook that is secured to a bulk bag and which hook can be used to overcome the past handling limitations of prior art bulk bags.

Still yet another and/or alternative non-limiting object of the invention is the provision of a bulk bag hook that is designed to be secured to the top or bottom portion of a bulk bag and includes a hook portion that can be used to removably secure the bulk bag to one or more regions of a cart.

Another and/or alternative non-limiting object of the invention is the provision of a bulk bag hook that is located on the end of the portion of the bulk bag that includes a barcode or identification code or within a distance of the end that is less than 25% the longitudinal length of the bulk bag.

Still another and/or alternative non-limiting object of the invention is the provision of a bulk bag hook that is generally centrally positioned between the two sides of the bulk bag or within ±15% of the central position between the two sides of the bulk bag.

Yet another and/or alternative non-limiting object of the invention is the provision of a bulk bag hook that is generally designed and positioned on the bulk bag so that the bulk bag hook does not interfere with the stacking of a plurality of bulk bags having bulk bag hooks on top of one another.

Still yet another and/or alternative non-limiting object of the invention is the provision of a bulk bag hook wherein the hook portion is designed to be removably secured to a shopping cart or the like so as to removably secure the bulk bag to the shopping cart and/or to function as a handle to enable a user to conveniently carry the bulk bag by the hook portion.

Another and/or alternative non-limiting object of the invention is the provision of a bulk bag hook wherein the base section is connected to the bulk bag by an arrangement that includes an adhesive.

Still another and/or alternative non-limiting object of the invention is the provision of a bulk bag hook wherein the hinge is a living hinge.

Still yet another and/or alternative non-limiting object of the invention is the provision of a bulk bag hook wherein a thickness of all or a portion of the hinge is thinner than the base section and/or hook portion that is connected to and/or located closely adjacent to the hinge.

Another and/or alternative non-limiting object of the invention is the provision of a bulk bag hook wherein a portion of the base section is located on both sides of the hinge and that the thickness of all or a portion of the hinge is thinner than the base section on each side of the hinge that is connected to and/or located closely adjacent to the hinge.

Still another and/or alternative non-limiting object of the invention is the provision of a bulk bag hook wherein the hook portion includes a hooking section that has a shape selected from the group consisting of a generally C-shape, generally U-shape, or generally V-shape that is designed to removably connect to a portion of a shopping cart or the like.

Yet another and/or alternative non-limiting object of the invention is the provision of a bulk bag hook wherein the hook portion includes a body section that is positioned between the hinge and the hooking section, and wherein the length of the body portion is such that when the body portion is generally positioned normal or tangentially to the top surface of the base section, the front end of the hooking section is spaced above the top surface of the base section.

Still yet another and/or alternative non-limiting object of the invention is the provision of a bulk bag hook that includes a latch member for the hook portion that is designed to releasably secure the hook portion.

These and other objects, features and advantages of the present invention will become apparent from the subsequent description taken in conjunction with the accompanying drawings.

BRIEF DESCRIPTION OF THE FIGURES

Reference may now be made to the drawings, which illustrate various non-limiting embodiments that the invention may take in physical form and in certain parts and arrangements of parts wherein.

DETAILED DISCUSSION OF NON-LIMITING EMBODIMENT

Figure 1:
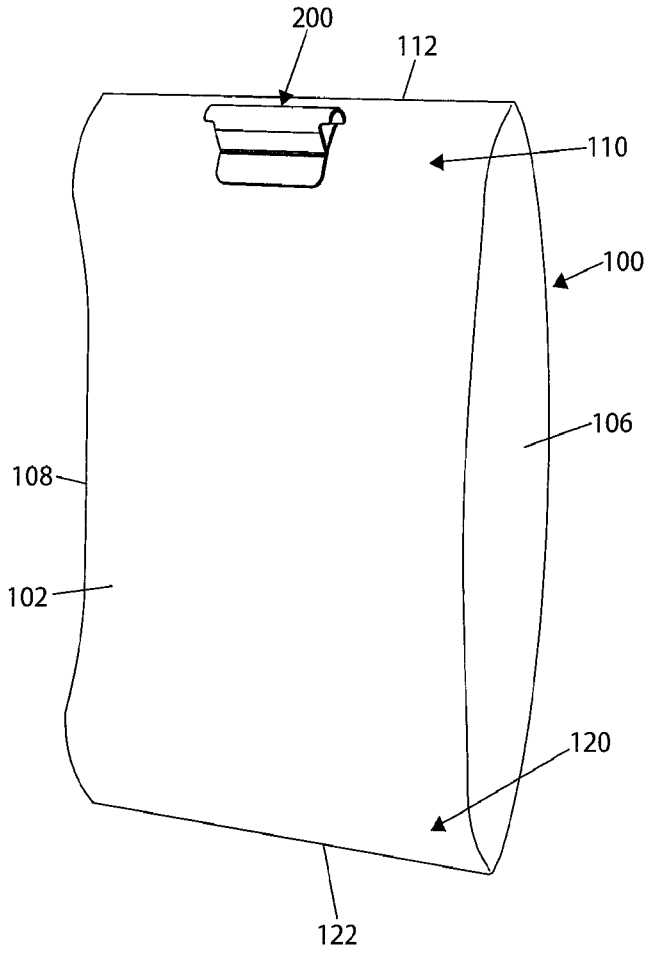
FIG. 1 is a front elevation view of a bulk bag that includes a bulk bag hook in accordance with the present invention.

Referring now to the drawings wherein the showing is for the purpose of illustrating non-limiting embodiments of the invention only and not for the purpose of limiting the same, as illustrated in FIGS. 1-4 there is illustrated a non-limiting bulk bag hook that can be used with a bulk bag in accordance with the present invention.

Figure 2:
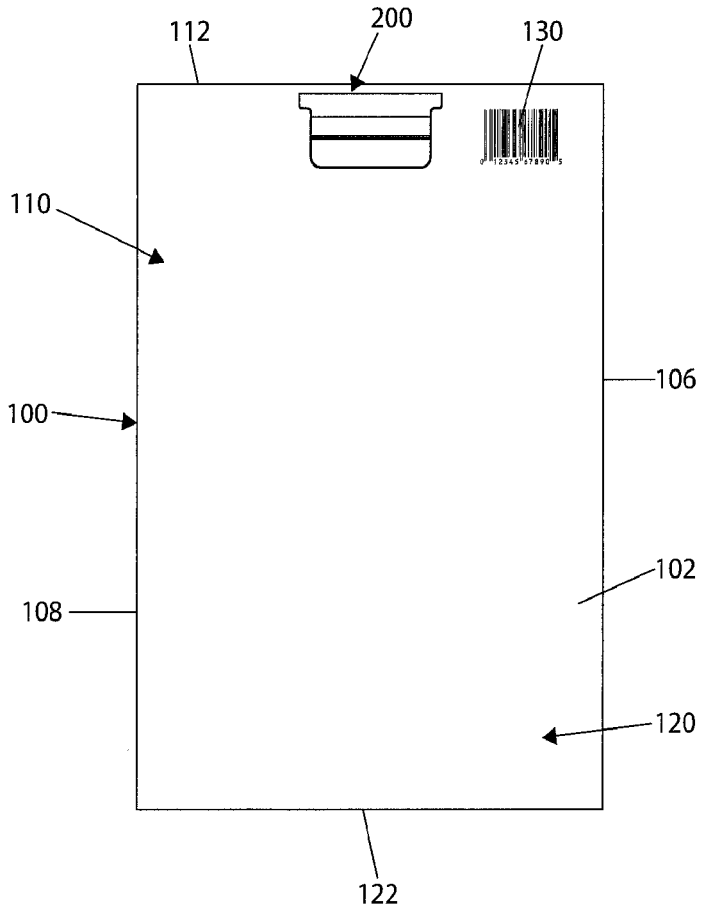
FIG. 2 is a front plan view of view of a bulk bag of FIG. 1.
Figure 3:
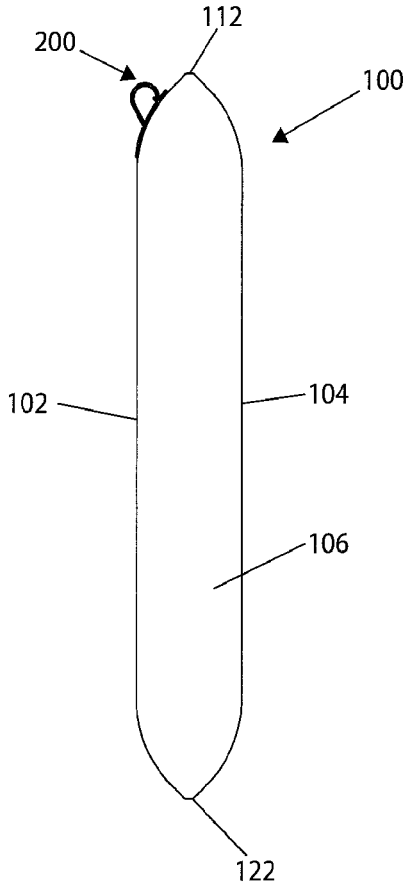
FIG. 3 is a side plan view of the bulk bag of FIG. 1.

Referring now to FIGS. 1 and 2, there is illustrated a bulk bag 100 that includes a bulk bag hook 200. The bulk bag is not limited to any shape or size. The bulk bag can be formed of any number of materials (e.g., paper, plastic, fabric, etc.). The bulk bag generally includes a front face 102, a back face 104, a first side 106, a second side 108, a top portion 110 having a top end 112, a bottom portion 120 having a bottom end 122, an inner cavity for containing a product, and a barcode or identification code 130 on said front face and positioned closer to said top end than to said bottom end. The bulk bag may or may not include seams between the sides of the bulk bag and the front and/or back face of the bulk bag. The top and bottom ends of the bulk bag are generally closed or sealed after a product is inserted into the inner cavity of the bulk bag. The arrangement used to close or seal the top and bottom ends is non-limiting (e.g., adhesive, stitching, melt connection, folding arrangement, etc.). Generally, the width of the front face as defined by the distance between the first and second sides is greater than the width of the first side or the second side; however, this is not required. The front and back face have a generally square or rectangular shape; however, other shapes can be used (e.g., circular, oval, polygonal, etc.). When the bulk bag is closed or sealed at the top and bottom ends, the first and second side has a generally oval shape; however, first and second sides can have other shapes (e.g., circular, polygonal, etc.).

The barcode or identification code 130 is a scannable code or symbol positioned on the top portion of the bulk bag at the front face, first side or second side of the bulk bag. As illustrated in FIG. 2, the barcode or identification code is positioned on the top portion of the bulk bag at the front face of the bulk bag. The barcode or identification code on the front face is positioned off-center of the front face.

The front face of the bulk bag includes the bulk bag hook 200. The bulk bag hook is generally non-releasably connected to the front face of the bulk bag. The bulk bag hook includes a base section 210, a hinge 250, and a hook portion 260. As illustrated in FIGS. 1-4, the bulk bag hook is formed of a single piece of material; however, this is not required.

Figure 4:
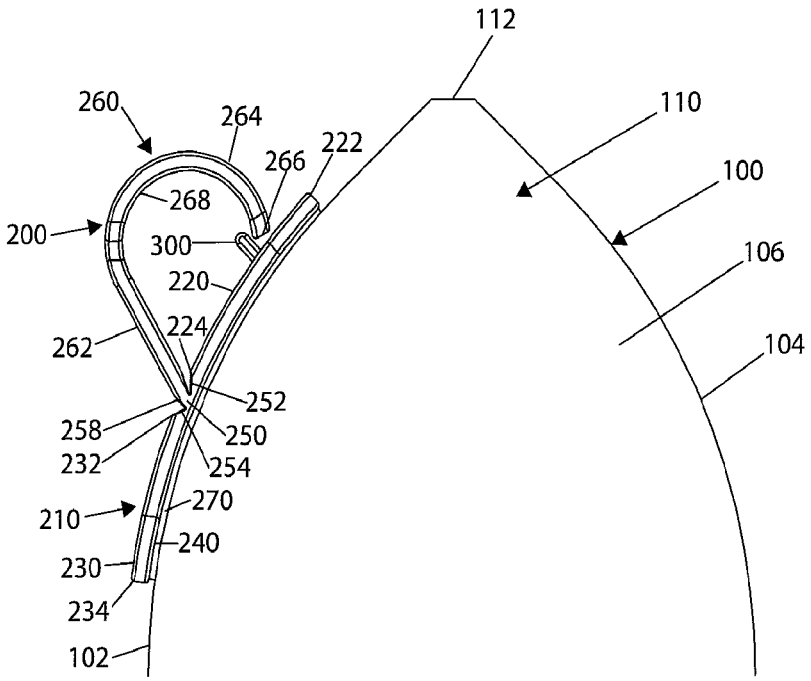
FIG. 4 is an enlarged side plan view of a top portion of the bulk bag of FIG. 1.

The base section includes first and second portions 220, 230 which each have front ends 222, 232 and back ends 224, 234. The thickness, shape, and configuration of the first and second portions can be the same or different. As illustrated in FIG. 4, the longitudinal length of the first portion is greater than the longitudinal length of the second portion; however, this is not required. The bottom surface 240 of the base section is adhesively connected to the front face of the bulk bag by an adhesive layer 270. Any number of adhesives can be used to secure the base section to the bulk bag. The adhesive can be the only means for securing the base section to the bulk bag; however, other or alternative means can be used to secure the base section to the bulk bag (e.g., stitching, rivets, clamp, melt connection, friction connection, etc.). The base section is non-releasably connected to the front face of the bulk bag. Only by damage to the front face of the bulk bag can the base section be removed from the bulk bag. The base section can be connected to the bulk bag prior to or after the inner cavity of the bulk bag has been filled with a product. Generally, the base section is connected to the bulk bag prior to the inner cavity of the bulk bag being filled with a product.

The hinge 250 is connected to the back end of the first portion of the base section and to the front end of the second portion of the base section as illustrated in FIG. 4. The hinge is generally a living hinge; however, this is not required. As illustrated in FIG. 4, the connection region of the hinge between the first and second portions of the base section has a thickness that is less than a thickness of the first and second portions at the point of connection with the hinge. As illustrated in FIG. 4, the hinge has sloped surfaces 252, 254 that result in the reduced thickness of the hinge at the connection region with the first and second portions of the base section. The sloped regions 256, 258 also exist between the hinge and the point of the connection with the hook portion 260. Sloped regions 252, 256 and sloped regions 254, 258 created a generally V-shape of the hinge between the base section and the hook portion as illustrated in FIG. 4; however, it can be appreciated that the sloped regions can form other shapes (e.g., C-shape, U-shape, etc.). As illustrated in FIG. 4, a portion of the hinge extends above the top surface of the base section at least at the region at or near the point of connection of the hinge with the first and second portions of the base section.

The hook portion 260 includes a body section 262 and a hooking section 264. The body section is connected between the hinge 250 and the hooking section 264. As illustrated in FIGS. 1-2, the width of the body portion is the same or less than the width of the base section; however, this is not required. As illustrated in FIGS. 1-2, the width of the hooking section is greater than the width of the body portion of the hook portion; however, this is not required. The longitudinal length of the body portion is generally selected such that when the body portion is positioned generally tangentially to the top surface of the base section, the front end 266 of the hooking section 264 is spaced above the top surface of the base section at a distance of at least about 0.25 inches (e.g., 0.25 inches to 2 inches, etc.). The hooking section 264 has a shape that is configured to releasably connect to a portion of a shopping cart. As illustrated in FIG. 4, the hooking section has a generally C-shape configuration; however, it can be appreciated that the hooking section can have other shapes (e.g., U-shape, V-shape, etc.). The inner surface 268 of the hooking section has an angle of curvature of at least about 90° (e.g., 90°-300°, etc.). As illustrated in FIG. 4, the hooking section has an angle of curvature of about 180°-220°.

The top surface of the base section can include a latch arrangement that is configured to releasably secure the hook portion relative to the top surface of the base section. As illustrated in FIG. 4, the arrangement is in the form of a tab 300 that extends upwardly from the top surface of the first portion of the base section. The tab is spaced from hinge 250. As illustrated in FIG. 4, the tab is positioned at least half way along the longitudinal length of the first portion of the base section and typically closer to the front end 222 than to back end 224 of the first portion of the base section; however, this is not required. The longitudinal length of the tab is generally less than the longitudinal length of body section 262 of the hook portion; however, this is not required. The tab is designed to cause the front end 266 of the hooking section 264 to engage with the top of the tab when the hook portion is pushed forwardly while pivoting on the hinge. When the front end 266 of the hooking section 264 engages the top of the tab, further forward force on the hook portion causes the hooking section to move over the top of the tab and into a locked position. The hook portion will not move from the locked position to an unlocked position until a force is applied to the hook portion to pull the hook portion away from the tab, thereby causing the front end 266 of the hooking section 264 to move over and past the top of the tab. As can be appreciated, other arrangements can be used to releasably secure the hook portion in a locked position. When the hook portion is not in the locked position, the hook portion cannot be connected to a cart. The latch arrangement can be used to maintain the hook portion in the locked position so as to minimize damage to the hook portion during the stacking and storing of the bulk bags; however, this is not required. The latch arrangement can also or alternatively be used to maintain the hook portion in the locked position so as to secure the bulk bag hook to a cart once the hook portion is connected to the cart; however, this is not required.

The bulk bag hook is designed to easily and conveniently secure a bulk bag to a shopping cart so that a user is not required to place the bulk bag in the cart or beneath the cart. The bulk bag hook can also function as a handle to make it more convenient and easy to lift and carry a bulk bag; however, this is not required.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed:

1. A hookable bulk bag that can be releasably secured to a shopping cart, said hookable bulk bag comprising a bulk bag and a bulk bag hook, said bulk bag having a front face, a back face, a first side, a second side, a top portion having a top end, a bottom portion having a bottom end, an inner cavity for containing a product, and a barcode or identification code on said top portion of said bulk bag, said bulk bag hook including a base section, a hinge and a hook portion, said base section non-releasably connected to an outer surface of said front face of said bulk bag and positioned closer to said top end than to said bottom end and spaced from said barcode or identification code, said hook portion including a hooking section having a shape that is configured to releasably connect to a portion of a shopping cart so that the bulk bag hangs from the shopping cart as the shopping cart is moved along a floor surface, said hinge connected between said base section and said hook portion, said hinge configured to enable said hook portion to move relative to said base section, wherein said base section includes a first portion having a front end and a back end, said hinge connected to said back end of said first portion, said hinge having a thickness at the point of connection with said back end of said first portion that is less than a thickness of said back end of said first portion, and wherein said base section includes a second portion having a front end and a back end, said hinge connected to said front end of said second portion, said hinge having a thickness at the point of connection with said front end of said second portion that is less than a thickness of said front end of said second portion, said hinge positioned between said first and second portions of said base section.

2. The hookable bulk bag as defined in claim 1, wherein said hinge is a living hinge.

3. The hookable bulk bag as defined in claim 1, wherein said base section, said hinge and said hook portion are formed of a single piece of material.

4. The hookable bulk bag as defined in claim 1, including a latch that is configured to releasably secure said hook portion to a top surface of said base section, said latch spaced from said hinge.

5. The hookable bulk bag as defined in claim 1, wherein said base section is non-releasably connected to an outer surface of said front face of said bulk bag by one or more arrangements selected from the group consisting of an adhesive, a rivet, stitching, a clamp arrangement, a melt connection, a friction connection, and a clamp backing.

6. The hookable bulk bag as defined in claim 1, wherein said hook portion includes said hooking section and a body section, said hooking section has a shape selected from the group consisting of a C-shape, a U-shape and a V-shape.

7. The hookable bulk bag as defined in claim 6, wherein a length of said body section when said body section is positioned tangentially to a top surface of said base section causes a front end of said hooking section to be spaced above said top surface of said base section a distance of 0.25 inches to 2 inches.

8. The hookable bulk bag as defined in claim 6, wherein said hooking section has an angle of curvature of an inner surface of the hooking section of at least 90°.

9. The hookable bulk bag as defined in claim 8, wherein said hooking section has an angle of curvature of the inner surface of the hooking section of 120° to 250°.

10. A method for manufacturing a bulk bag that includes a bulk bag hook that can be used to releasably secure the bulk bag to a shopping cart comprising:

a. providing a bulk bag, said bulk bag having a front face, a back face, a first side, a second side, a top portion having a top end, a bottom portion having a bottom end, an inner cavity for containing a product, and a barcode or identification code on said top portion of said bulk bag;

b. providing a bulk bag hook, said bulk bag hook including a base section, a hinge and a hook portion, said base section designed to be non-releasably connected to an outer surface of said front face of said bulk bag and positioned closer to said top end than to said bottom end and spaced from said barcode or identification code, said hook portion including a hooking section having a shape that is configured to releasably connect to a portion of a shopping cart, said hinge connected between said base section and said hook portion, said hinge configured to enable said hook portion to move relative to said base section, wherein said base section includes a first portion having a front end and a back end, said hinge connected to said back end of said first portion, said hinge having a thickness at the point of connection with said back end of said first portion that is less than a thickness of said back end of said first portion, and wherein said base section includes a second portion having a front end and a back end, said hinge connected to said front end of said second portion, said hinge having a thickness at the point of connection with said front end of said second portion that is less than a thickness of said front end of said second portion, said hinge positioned between said first and second portions of said base section;

c. securing a bottom surface of said base section to said front face of said bulk bag, said base section positioned adjacently to said barcode or identification code, said base section positioned closer to said top end than to said bottom end of said bulk bag, said bottom surface of said base section connected to said front face of said bulk bag by one or more arrangements selected from the group consisting of an adhesive, a rivet, stitching, a clamp arrangement, a melt connection, a friction connection, and a clamp backing.

11. The method as defined in claim 10, wherein said base section positioned centrally between said first and second sides of said bulk bag.

12. The method as defined in claim 10, wherein said hinge is a living hinge.

13. The method as defined in claim 10, wherein said base section, said hinge and said hook portion are formed of a single piece of material.

14. The method as defined in claim 10, including a latch that is configured to releasably secure said hook portion to a top surface of said base section, said latch spaced from said hinge.

15. The method as defined in claim 10, wherein said base section is non-releasably connected to an outer surface of said front face of said bulk bag by one or more arrangements selected from the group consisting of an adhesive, a rivet, stitching, a clamp arrangement, a melt connection, a friction connection, and a clamp backing.

16. The method as defined in claim 10, wherein said hook portion includes said hooking section and a body section, said hooking section has a shape selected from the group consisting of a C-shape, a U-shape, and a V-shape.

17. The method as defined in claim 16, wherein said hooking section has an angle of curvature of an inner surface of the hooking section of at least 90°.

18. The method as defined in claim 17, wherein said hooking section has an angle of curvature of the inner surface of the hooking section of 120° to 250°.

19. The method as defined in claim 17, wherein a length of said body section when said body section is positioned tangentially to a top surface of said base section causes a front end of said hooking section to be spaced above said top surface of said base section a distance of 0.25 inches to 2 inches.

* * * * *